US006057043A

United States Patent [19]

Kametani et al.

[11] Patent Number: 6,057,043

[45] Date of Patent: May 2, 2000

[54] TRANSFER PRINTING FILM

[75] Inventors: Ryuhei Kametani, Osaka; Masaru Hirukawa, Kyoto, both of Japan

[73] Assignee: Kametani Sangyo Kabushiki Kaisha, Osaka, Japan

[21] Appl. No.: 09/056,781

[22] Filed: Apr. 8, 1998

[51] Int. Cl.[7] ..... B41M 5/26

[52] U.S. Cl. ..... 428/474.4; 428/195; 428/500; 428/522; 428/913; 428/914

[58] Field of Search ..... 428/195, 474.4, 428/500, 522, 913, 914

[56] References Cited

FOREIGN PATENT DOCUMENTS 4-63269 5/1992 Japan .
7-89214 4/1995 Japan .
53-63137 6/1998 Japan .

*Primary Examiner*—Pamela R. Schwartz
*Attorney, Agent, or Firm*—Barnes & Thornburg

[57] ABSTRACT

The invention provides a transfer printing film for thermally printing patterns on golf balls. An ink layer disposed on one side of a substrate film contains as a main vehicle a polyamide bearing methoxymethyl group or a vinylchloride-vinylacetate-vinylalcohol copolymer bearing hydroxyl group. Softening point of the polyamide or the copolymer is relatively low, and thus, the pattern formed by the ink layer is transfered at a lower temperature. Both the methoxymethyl group of the polyamide and the hydroxyl group of the copolymer reacts with isocyanate group to form urethane bond, and thus, in the operation of finishing the golf ball with a two-component urethane paint, urethane bondings are formed between the urethane clear top coat and the printed pattern.

4 Claims, No Drawings

TRANSFER PRINTING FILM

FIELD OF THE INVENTION

The present invention relates to a transfer printing film for printing patterns on articles, and more particularly to a transfer printing film for thermally printing patterns on golf balls.

BACKGROUND OF THE INVENTION

A transfer printing film for transfer printing patterns comprising any combination of logo, words, numbers, etc. on various kinds of articles generally includes a strip-shaped substrate film and an ink layer disposed on one side of the substrate film by means of gravure or screen printing to form the pattern. In the operation of applying pattern to the article, the transfer printing film is so placed that the pattern thereof is positioned in a predetermined printing area of a surface of the article, and the film is pressed to the article by a thermall pad under a certain pressure, whereby the heated ink layer is transfered from the substrate film to the article. Particularly, in case of printing patterns on golf balls, it is strongly desired that the transfered ink layer should not be removed easily.

Generally, the golf balls are, after the pattern was printed, subjected to urethane finish which is substantially carried out by spraying a two-component urethane paint. The clear urethane top coat covers the golf ball and the printed pattern to improve their appearance and to protect them from dirt, scratch, etc. But, when an adhesion between the urethane layer of the top coat and the ink layer of the printed pattern is weak, a hitting durability of the ink layer becomes low and the ink layer tends to be easily removed.

In order to enhance the adhesion between the two layers, Japanese Unexamined Patent Publication No.89214/95 discloses a transfer printing film for printing patterns on golf balls, whose ink layer contains as a vehicle a urethane resin having a predetermined hydroxyl value. Accordingly, when the two-component urethane paint is sprayed onto the golf ball, the hydroxyl-functioned urethane resin in the ink layer on the surface of the golf ball reacts with the isocyanate-functioned resins existing in one of the two components of the paint to form urethane bondings, and thus, the adhesion between the urethane finish layer and the ink layer becomes strong, a hitting durability is improved and the ink layer tends to be hardly removed.

On the other hand, the Patent Publication mentioned above teaches us that in the operation of applying pattern, the transfer printing film is pressed by a silicone pad heated up to 130° C. to transfer the ink layer to the golf ball. It is known to the art that a lower transfer temperature is preferable by several reasons. One is, clearly, for reason of energy cost and the other for reason of heat damage of the article. When the article is a golf ball, for example, the ball and its dimples will be distorted under the higher transfer temperature. The higher transfer temperature may also cause a shrinkage of the substrate film which consists of a synthetic resin such as polypropylene, a glassine or a laminated paper composed of the two, and as a result, the shrinkage of the substrate film causes a crease or a distortion of the pattern transfered to the article. Moreover, it takes a longer time to heat the ink layer up to the higher temperature and a productivity will be lowered.

In this aspect, the transfer printing film according to the above-mentioned Patent Publication has a drawback that it is likely to need essentially a higher transfer temperature because the ink layer of which comprises as a main vehicle a urethane resin whose softening temperature is relatively high.

Consequently, it is an object of the present invention to provide a transfer printing film capable of printing patterns at a lower temperature, while realizing an enhancement of the adhesion between the patterns and the top coat.

On the other hand, as far as the transfer printing film for golf balls is concerned, it is specifically desired that the ink layer should have an enough flexibility to stretch on the spherical surface of the ball without a crack of the pattern, that the ink layer should be superior in adhesion to an ionomer resin coated on the ball surface, and that the pattern printed on the ball surface should not be blurred when spraying the urethane paint.

Accordingly, it is another object of the present invention to provide a transfer printing film for printing patterns on golf balls, which can meet the desires mentioned above.

SUMMARY OF THE INVENTION

As the result of our researches to attain the above objects, we have eventually found that by the use of a polyamide having methoxymethyl group or a vinylchloride-vinylacetate-vinylalcohol copolymer having hydroxyl group as the vehicle in the ink layer, the pattern may be printed on the golf balls without any cracks at a lower temperature, the pattern may have a superior adhesiveness both to the ball surface and to the urethane top coat, and the pattern printed may not run into the urethane paint sprayed.

DETAILED DESCRIPTION OF THE INVENTION

According to the invention, the ink layer applied on one side of the substrate film contains a polyamide or a vinylchloride-vinylacetate-vinylalcohol copolymer, each having an advantage over the urethane resin in that its softening point is lower. Therefore, in the operation of printing pattern, it is possible to lower the transfer temperature, and thus, the energy cost may be reduced, the heat damage of the article and the pattern may be diminished, and the high-speed printing may be maintained.

The polyamide or the vinylchloride-vinylacetate-vinylalcohol copolymer is superior in flexibility, and thus, the ink layer may well stretch on the spherical ball surface and the pattern may be transfered without cracks.

Furthermore, according to the invention, the polyamide bears methoxymethyl group and the copolymer hydroxyl group, each functional group having a reactivity with isocyanate group to form urethane bond. Therefore, in the operation of finishing the golf ball by spraying the two-component urethane paint, the methoxymethyl-functioned polyamide or the hydroxyl-functioned copolymer in the ink layer on the golf ball surface reacts with the isocyanate-functioned resins existing in the sprayed urethane paint so as to form urethane bondings, whereby the adhesion between the top coat and the pattern is enhanced, and thus, printed pattern may be hardly removed from the golf ball surface and hitting durability is improved.

The substrate film employed in preparation of the transfer printing film of the present invention may be a conventional film used as the substrate film, such as an oriented or a non-oriented polypropylene film, a laminated film composed of polypropylene film and glassine, and the like.

In addition to the polyamide or the copolymer, the ink layer of the transfer printing film of the present invention may further comprise an epoxy resin, a dyestuff such as carbon black and the like, a filler, a plasticizer, etc. and a solvent to dilute them in an adequate concentration.

Applying method for the ink layer onto the substrate film employed in preparation of the transfer printing film of the present invention may be a conventional printing method, such as gravure printing or screen printing method.

A content of the polyamide or the copolymer is preferably 12 to 18 weight % in the ink composition. When the content is lower than 12 weight %, the above-mentioned advantage of the polyamide or the copolymer that it has a lower softening point and a good flexibility will be drastically decreased. On the contrary, even if the content is higher than 18 weight %, the above-mentioned advantage of the polyamide or the copolymer will not be increased effectively.

An amount of the methoxymethyl group in the polyamide or the hydroxyl group in the copolymer directly reflects on a degree of urethane bonding between the top coat and the pattern, and it is preferably 1 to 3 in a hydroxyl value.

EXAMPLES

The present invention is illustrated by the following Examples which, however, are not to be constructed as limiting the present invention to their details.

An oriented polypropylene film with 20 $\mu$m thickness was employed as a substrate film. On one side of the film, a letter "H" (3 mm×3 mm×1 $\mu$m in thickness) was printed by means of gravure printing method with an ink, each prepared in a composition as shown in Table 1 (Example A to D).

As an article to which the above letter "H" is transfer printed, a plasma treated golf ball coated with ionomer resin was employed. Each of the transfer printing film of the present invention was pressed to the golf ball surface by a silicone pad heated up to 90° C. for 1 second. Then, a two-component urethane paint was sprayed onto the golf ball and dried to cure.

As for each of the finished golf ball, a hitting durability was evaluated by hitting the ball against a steel plate two hundred times at a speed of 140 kilometers an hour. A wear resistance was also evaluated by milling the ball with sand for two hours. And the appearance of the printed pattern "H" was observed with naked eye. As the result, every letter "H" printed on golf balls were not removed from the ball surface and well remained readable without cracks.

TABLE 1

| Ink composition (parts by weight) | Example A | Example B | Example C | Example D |
|---|---|---|---|---|
| Polyamide (contents of methoxymethyl group in hydroxyl value) | 12 (3) | 18 (3) | — | — |
| Vinylchloride-vinylacetate-vinylalcohol copolymer (contents of hydroxyl group in hydroxyl value) | — | — | 12 (3) | 18 (3) |
| Epoxy resin | — | — | 2 | 2 |
| Plasticizer | — | — | 12 | 12 |
| Carbon black and filler | 30 | 30 | 20 | 20 |
| Butyl alcohol | 30 | 30 | — | — |
| Cyclohexanone | — | — | 26 | 26 |
| Benzylalcohol | 10 | 10 | — | — |
| Xylene | 5 | 5 | — | — |
| Aromatic solvent of high b.p. | 10 | 10 | 25 | 25 |

What is claimed is:

1. A transfer printing film having an ink layer disposed on one side of a substrate film, said ink layer comprising a polyamide having methoxymethyl group.

2. The transfer printing film according to claim 1, wherein a content of the polyamide is 12 to 18 weight % in the ink composition.

3. A transfer printing film having an ink layer disposed on one side of a substrate film, said ink layer comprising a vinylchloride-vinylacetate-vinylalcohol copolymer having hydroxyl group.

4. The transfer printing film according to claim 3, wherein a content of the copolymer is 12 to 18 weight % in the ink composition.

* * * * *